United States Patent [19]

Sennett et al.

[11] Patent Number: 4,559,105

[45] Date of Patent: Dec. 17, 1985

[54] POSITIVE LOCK FOIL BLADES

[75] Inventors: Thomas Sennett, Beloit, Wis.; Jimmy L. Guetschow, South Beloit, Ill.

[73] Assignee: Beloit Corporation, Beloit, Wis.

[21] Appl. No.: 628,031

[22] Filed: Jul. 5, 1984

[51] Int. Cl.[4] ..... D21F 1/54; D21F 1/48

[52] U.S. Cl. ..... 162/352; 162/374

[58] Field of Search ..... 162/374, 352, 208, 211, 162/217

[56] References Cited

U.S. PATENT DOCUMENTS

| | | | |
|---|---|---|---|
| 3,017,930 | 1/1962 | Dunlap | 162/352 |
| 3,450,098 | 6/1969 | Williams, Jr. | 118/126 |
| 3,529,315 | 9/1970 | Dunlap et al. | 15/256.51 |
| 3,576,716 | 4/1971 | Reynolds et al. | 162/352 |
| 3,953,284 | 4/1976 | Evälahti | 162/352 |
| 4,162,937 | 7/1979 | Corbellini | 162/352 |
| 4,184,915 | 1/1980 | Metcalf | 162/374 |
| 4,334,958 | 6/1982 | Baluha et al. | 162/352 |

*Primary Examiner*—S. Leon Bashore
*Assistant Examiner*—K. M. Hastings
*Attorney, Agent, or Firm*—Hill, Van Santen, Steadman & Simpson

[57] ABSTRACT

In a forming section of a papermaking machine, a foil blade for being positioned in close running relation with a wire for dewatering a web on the wire, a mount for the foil positioned to support the foil in its operative position and an inflatable member between the mount and foil securing the foil tightly in operative position preventing rocking when inflated and releasing the foil when deflated so that the foil can be slid out in a cross-machine direction.

1 Claim, 4 Drawing Figures

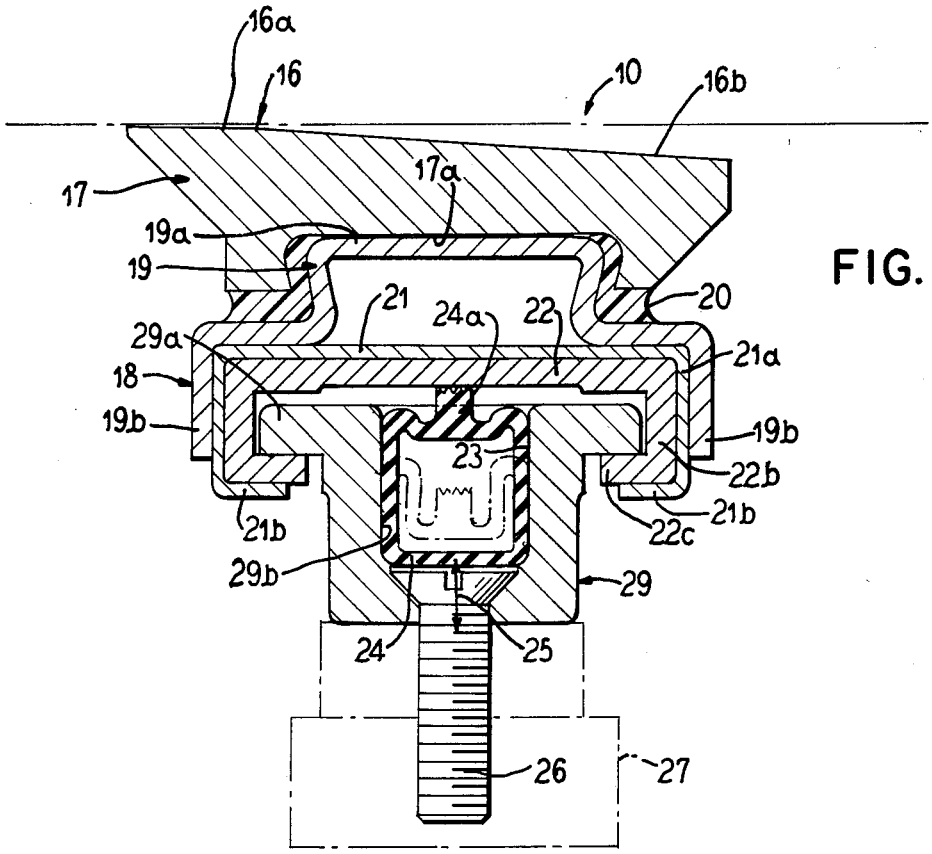
FIG. 1
FIG. 2
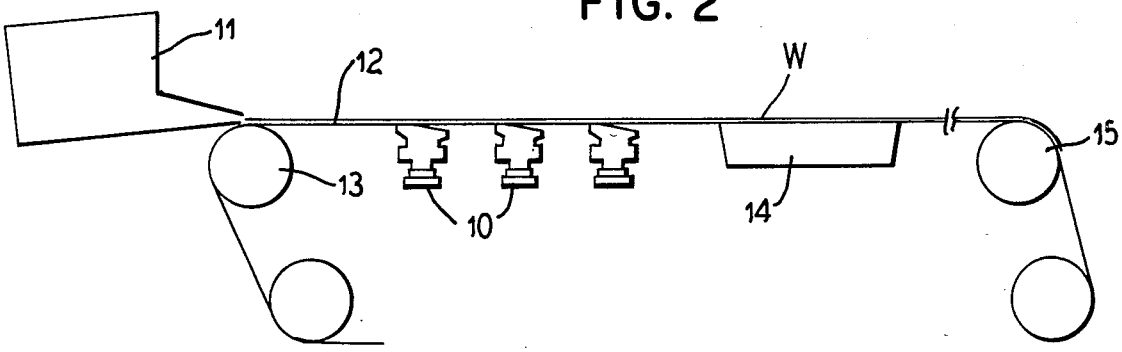

POSITIVE LOCK FOIL BLADES

BACKGROUND OF THE INVENTION

The invention relates to improvements in papermaking machines, and more particularly to a positive locking foil blade mechanism wherein an improved foil blade structure and mount therefor is provided which positively positions the blade in operative position and permits removal thereof.

In a papermaking machine a traveling forming wire receives stock from the slice of the headbox with the stock being dewatered through the wire. One of the dewatering devices normally includes a foil which has an upper surface of soft or hardened material which is accurately positioned to form a diverging angle in the machine direction with the wire so as to cause an area of reduced pressure and help in dewatering the stock through the wire. It is imperative in the relationship between the foil blade and the wire that a uniform positional relationship be maintained with respect to the divergent angle of the foil relative to the wire. The foil blades wear with operation of the machine, and a typical arrangement permits removal of the foil blades and replacement with a reworked or fresh blade. Frequently, a T-bar support is provided which supports the blade and permits removal in a cross machine direction Typically, the tolerance between the conventional foil blade and the mounting T-bar is in the area of 0.008" to 0.20" loose. This loose fit tolerance between the foil blade and T-bar causes the blade to rock on the T-bar mounting, contributing to sheet rewet, dirt and fiber buildup on the blade with resultant possible worming or streaking of the paper sheet being produced. Also, deterioration of the paper formation from vacuum loss with the blade improperly positioned relative to the wire can occur. If tolerances are reduced, it becomes difficult or impossible for the papermaker to remove the blade from its position during operation. It is accordingly an object of the present invention to provide an improved foil blade mount which has a positive lock mechanism capable of tightly securing the loose fitting foil blade in an accurate operative position.

While the features of the invention find particular application in supporting a foil blade, it should be appreciated that the mounting structure can be utilized in mounting foils, deflector blades, forming board blades, blades for forming shoes and the like. For convenience the description will be presented with reference to a foil blade, but it will be understood that this is by way of description and not by way of limitation.

Another object of the invention is to provide a positive lock mechanism for a foil blade or other mechanism in close running relationship beneath a wire wherein a special holder is provided which is capable of holding the mechanism in a predetermined positive stop position during operation, and yet releasing the mechanism for easy and rapid removal for replacement.

Another object of the present invention is to provide an improved mechanism such as a foil blade and holder which can be locked during operation which offers advantages over structures heretofore available in that it is not difficult to keep clean, is not subject to weakening or deterioration of mechanical locking parts with continued operation, and is capable of adapting to the use of polyblades or ceramics or the use of additional adaptor parts without increasing down time for changes.

A still further object of the invention is to provide an improved support for foil blade or other mechanism and locking device therefor which is capable of very accurately locating the foil blade during operation and is capable to a degree of absorbing shaking and vibration of the foil during operation.

It is a feature of the invention to provide a foil blade mounted on a structured holder with the holder shaped to slide over a T-shaped mount. The mount is structured with a cross-machine slot fitted with an inflatable member therein which positions the holder rigidly relative to the mount during operation and which releases the holder for loose sliding relationship with deflation.

Other objects, advantages and features will become more apparent with the teaching of the principles of the invention in connection with the disclosure of the preferred embodiment thereof in the specification, claims and drawings, in which:

DESCRIPTION OF THE DRAWINGS

FIG. 1 is a vertical sectional view taken through a foil blade and support mechanism constructed and operating in accordance with the principles of the invention;

FIG. 2 is a schematic illustration of a fourdrinier section of a forming machine illustrating the relative location of the foil blade. The foil assembly is shown schematically somewhat larger than it normally would appear relative to the other parts;

DESCRIPTION OF THE PREFERRED EMBODIMENT

Figure 3:
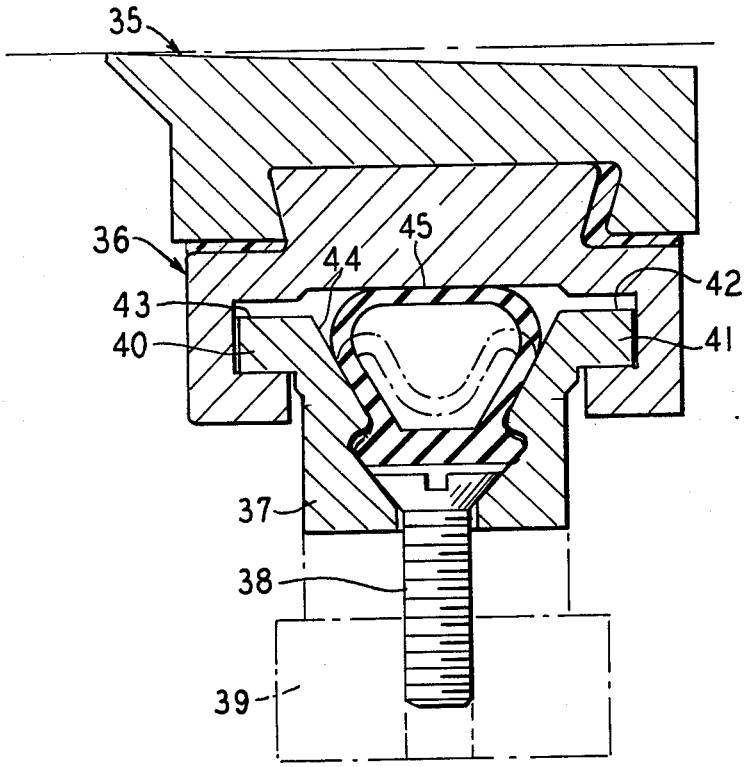
FIG. 3 is a vertical sectional view similar to FIG. 1, but illustrating another form of the invention.

As illustrated in FIG. 2, a foil blade assembly 10 is provided which is located beneath a traveling fourdrinier wire 12, FIG. 2, in a papermaking machine. The fourdrinier wire passes over a breast roll 13 and over a couch roll 15 at the end of its run. A web W is formed on the wire. Beneath the wire are dewatering devices shown as the foils 10 and a suction box 14, although it will be understood that in a typical papermaking machine other and more numerous dewatering devices will be provided, and this will be fully appreciated by those versed in the art. For depositing stock on top of the wire, a headbox is provided with a slice and the stock is dewatered downwardly through the wire with savealls and other means provided to receive the water which is drawn downwardly through the wire.

FIG. 1 illustrates in greater detail the foil blade mechanism with the foil blade 17 supported in operative position beneath the wire. The foil blade has a hard upper surface 16 with a lead-in flat portion **16*a* and a trailing portion 16*b*** which will diverge away from the wire on the downrunning side to cause a negative pressure and aid in the drainage of water from the stock through the wire.

As stated hereinabove, while the features of the structure are particularly useful in supporting a foil blade, it will be understood that the support may be utilized for other mechanisms such as deflector blades, forming board blades, blades for forming shoes and the like, and for convenience of description reference will be made to the support being utilized for a foil blade, but it will be understood that this is by way of description and not by way of limitation.

The foil blade has a recess 17*a* on its lower surface for aiding in mounting it on a holder 18. The holder is carried on a mount 19 which is supported on a frame 27. As will become more clear with a description of the detailed parts, the blade assembly 17 is arranged so as to be laterally slidable off of the mount 29 for removal of the blade and holder assembly.

The holder assembly 18 has an upper holder 19 with an upper projecting portion 19*a* which seats in a recess 17*a* in the blade. The blade is cemented or otherwise secured to the part 19*a* of the holder such as by a silicon rubber 20. The blade 17 is normally made of a very hard material and must be uniformly supported along its length so that cementing to the holder is a practical way of securing the blade 17.

The manner in which the blade is supported on its holder assembly 18 is not material, and this assembly may be produced in various mechanical arrangements. The blade and holder and holder may, for example, be produced by a manufacturer and purchased as an assembly with the holder 29 and its detailed related parts constructed in accordance with the principles as will be apparent from the description of the related parts.

The holder 19 has downwardly extending sides 19*b* which straddle an intermediate part 21 of the holder assembly. The intermediate part 21 has downwardly extending sides 21*a* which are turned inwardly at their lower edges at 21*b* to lock beneath a lower part 22 of the holder assembly. The upper part and intermediate part are soldered or otherwise welded to each other along their length.

For carrying the entire holder assembly and blade, a continuous cross-machine mount 29 is provided which is constructed of stainless steel or other suitable material. The mount is suitably secured to the frame 27 such as by having downwardly extending openings at intervals through which screws 26 extend threaded into the frame and securing the mount rigidly on the frame.

The mount is essentially T-shaped with laterally extending ribs 29*a* at each side. The lower surfaces of the ribs have downwardly facing shoulders which are machined to provide a positive stop surface against which the inwardly turned flanges 22*c* of the lower holder engage.

The mount 29 is provided with a continuous center groove or slot having side walls 23 and 29*b*, in which is seated an inflatable member 24. The inflatable member 24 has a suitable valving means shown schematically at 25 for inflating and deflating. The inflatable member is a continuous hollow tube having an upwardly extending integral central projection 24*a* engaging the lower surface of the part 22 of the holder assembly. As may be seen by the solid line position, when the inflatable member is inflated, it will push upwardly on the holder assembly to move and hold the blade in its operative position. When the inflatable member is deflated as shown by the dotted line position in FIG. 1, the holder assembly is released and dropped so that the part 22 of the holder assembly will drop down to seat on top of the mount 29. This will relieve the force between the wire and blade, making it easy to slide the blade out laterally. For this purpose, the groove formed by the flanges 22*c* has a greater depth than the ribs 29*a* of the mount so that the deflation of the inflatable member will leave the holder fairly loose on the mount. This permits the foil blade assembly to be slid laterally in a cross-machine direction from beneath the wire and a fresh foil blade assembly to be put in place.

FIG. 3 illustrates another form of support mechanism. A foil 35 or other similar mechanism is carried on a holder 36. The holder has downwardly and inwardly extending flanges to provide inwardly facing grooves 42 and 43.

These grooves 42 and 43 receive outwardly extending ribs 40 and 41 on a mount 37. The mount 37 is supported on spaced screws 38 threaded into a frame member 39.

The ribs 40 and 41 are thinner than the height of the slots or grooves 42 and 43 so that the ribs can slide easily in the slots. For rigidifying the position of the foil 35 on the mount 30, an inflatable member 45 is placed in a channel 44 extending the length of the mount. When the inflatable member 45 is inflated to the solid line position, the holder 36 is pushed upwardly so that the ribs 40 and 41 lock tightly against the flanges at the base of the grooves 42 and 43. When the tube 45 is deflated to the dotted line position, the ribs are loosened in the grooves so that the holder assembly 36 with its blade 35 easily slides laterally in a cross-machine direction for removal and replacement. When the holder and blade are slid back into position, the tube 45 is inflated so as to provide a rigid relationship between the position of the mount 37 and the blade and holder supported thereby. Thus, the inflatable member 45 applies a constant holding pressure positively fixing the operating position of the foil blade 35. The inflatable member accommodates looseness in parts, is impervious to water and in a vibration absorbing fashion, rigidly fixes the relative position of the parts. The tube 45 is unitary in a cross-machine direction or made in compartments with suitable valve mechanism for inflation and deflation.

Figure 4:
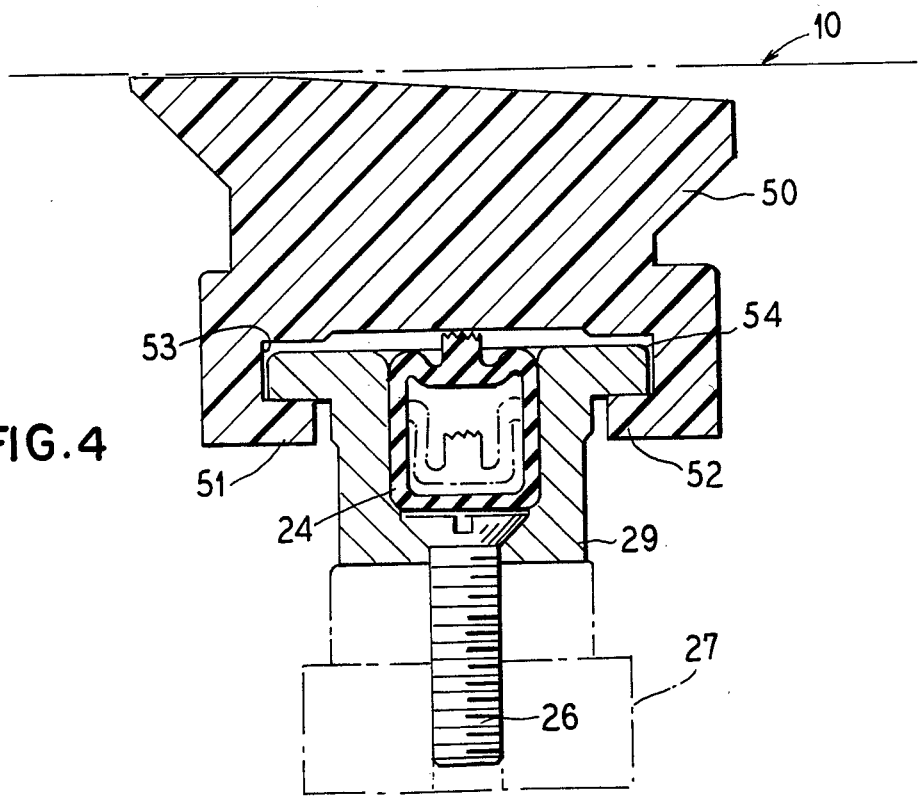
FIG. 4 is another vertical sectional view illustrating a modified form of the foil blade.

FIG. 4 illustrates a modified form of the invention wherein a one-piece foil blade 50 is provided formed of a material such as polyethylene. The entire blade 50 can be machined in one piece which has the same shape and features as the blade with its holder 36 of FIG. 3. The integral blade and holder 50 has inwardly extending flanges 51 and 52 to provide the grooves 53 and 54 so as to be supported on the mount and locked in position by the inflatable member 24 in the same manner as shown in connection with FIGS. 1 and 3. The form of inflatable member 24 is shown as being the same as in FIG. 1, but the inflatable member of FIG. 3 could also be adopted.

In operation, the mount 29 is fixedly held in place on the frame 27. A foil blade assembly is slid over the mount in the cross-machine direction until the blade is fully inserted beneath the wire. Sliding is easy because the slots in which the ribs 29*a* extend are considerably higher than the ribs. When the foil blade assembly is in place, the inflatable member 24 is inflated by its valve 25 so that it presses upwardly against the lower part 22 of the holder assembly. The inturned flanges 22*c* engage the shoulders 29*b* which fixedly positions the foil. Thus, the inflatable member applies a constant holding pressure which positively fixes the operating location of the foil blade 17. Yet, the inflatable member tends to absorb vibrations. The inflatable member also accommodates the looseness in parts and is completely impervious to water and fibers. The surfaces position the foil face downwardly insofar as the mount is concerned so that they are not likely to get coated with foreign elements or fibers. Also, the structure is capable of being manufactured with most parts requiring loose tolerances.

The foil blade 17 will be very positively positioned in a fore and aft direction, that is, in a machine direction since the flanges 29*a* of the mount can be positioned an adequate distance laterally apart. The possibility of the foil blade rocking in a machine direction is essentially limited. Yet, this can be acccomplished with the pressure of the inflatable rubber member 24 being located in the center of the mount.

In manufacture, the position of the foil blade need be located accurately only relative to the upwardly facing surfaces of the flanges 22*c* of the lower holder member. With this accurate positioning, the blade will always be brought to the proper height along its full length by the inflation of the inflatable member 24. Further, the angle of the blade will always remain correct and constant in the machine direction. The blade will assume the correct and proper operating height along its length and any tendency of the blade to bend will be eliminated by the vertical force applied by the inflatable member which will force the blade to assume a straightline as determined by the rigid mount 29.

This accurate location of the blade in a vertical position, and its being forced to maintain the proper angle relative to the wire will insure uniform dewatering across the wire and eliminate the possibility of streaking in the web and the possibility of nonuniform dewatering across the width of the wire. Yet, this structure is forced to assume a very accurate position during operation, but is instantly fully released for removal of the blade by pulling it laterally up from beneath the wire. The inflatable rubber seal is impervious to foreign materials which may be present and does not need to be accurately inflated and a pressure only sufficient to rigidly hold the blade upwardly so that its holder is firmly against the mount is all that is needed. Thus, it will be seen that we have provided an improved foil blade mounting for a papermaking machine which achieves the objectives and advantages above set forth and which provides advances over structures heretofore available.

We claim as our invention:

1. A positive locking foil blade mechanism for papermaking machine comprising in combination:

a foil having a substantially flat upper face arranged to diverge away from a traveling wire;

an upper holder for the foil with means attaching the foil to the upper holder and movable toward and away from said wire;

an intermediate holder attached to the upper holder for co-movement therewith;

a lower holder attached to said intermediate holder for co-movement therewith and having downwardly extending sides and under-hanging flanges turning toward each other at the lower ends of the sides;

a fixed mount having laterally extending ribs respectively received inside said sides and underhanging flanges of said lower holder such that a bottom of said ribs engages said flanges in an operative position of the foil in contact with said wire;

means defining a single continuous channel extending longitudinally through the mount, said channel located intermediate said shoulders and flanges;

an inflatable element in said channel having an upwardly extending projection positioned for engagement with the lower holder upon inflation of said inflatable element for holding the flanges in engagement with the ribs and positively fixing the operating position of the foil, said projection withdrawing completely into said channel upon deflation of said inflatable element permitting said lower holder to rest substantially flush on said fixed mount with said bottoms of said ribs and said under-hanging flanges out of engagement;

and means for inflating and deflating the inflatable element.

* * * * *